US009204706B1

(12) United States Patent
Applebee

(10) Patent No.: US 9,204,706 B1
(45) Date of Patent: Dec. 8, 2015

(54) DISPOSABLE BODY LOTION APPLICATOR

(71) Applicant: Shane R. Applebee, Ashville, NY (US)

(72) Inventor: Shane R. Applebee, Ashville, NY (US)

( * ) Notice: Subject to any disclaimer, the term of this patent is extended or adjusted under 35 U.S.C. 154(b) by 0 days.

(21) Appl. No.: 14/045,021

(22) Filed: Oct. 3, 2013

(51) Int. Cl.
*A45D 40/26* (2006.01)
*A45D 44/00* (2006.01)

(52) U.S. Cl.
CPC ..... *A45D 44/00* (2013.01)

(58) Field of Classification Search
USPC ..... 132/200, 320; 424/401, 402, 59, 65, 69, 424/78.02, 78.03
See application file for complete search history.

(56) References Cited

U.S. PATENT DOCUMENTS

| | | | | |
|---|---|---|---|---|
| 1,488,076 | A | | 3/1924 | Tebo |
| 1,609,796 | A | | 12/1926 | Cheney |
| 1,999,799 | A | | 4/1935 | Beck et al. |
| 3,048,851 | A | | 8/1962 | Bickford |
| 3,699,602 | A | | 10/1972 | Cameron |
| 3,778,172 | A | | 12/1973 | Myren |
| 4,185,330 | A | | 1/1980 | Stager |
| 4,186,445 | A | | 2/1980 | Stager |
| 4,228,557 | A | | 10/1980 | De Vivo et al. |
| 4,360,159 | A | | 11/1982 | Haynes |
| 4,567,065 | A | * | 1/1986 | Schneiderman ..... 427/230 |
| 4,633,857 | A | | 1/1987 | Czeczerski |
| 4,643,725 | A | | 2/1987 | Schlesser et al. |
| 4,759,652 | A | | 7/1988 | Ulrich |
| 4,817,227 | A | | 4/1989 | Scott |
| 4,916,757 | A | * | 4/1990 | Berlin et al. ..... 2/159 |
| 5,105,484 | A | | 4/1992 | Forsythe |
| 5,636,406 | A | * | 6/1997 | Strong ..... 15/227 |
| 5,810,201 | A | | 9/1998 | Besse et al. |
| 5,922,336 | A | * | 7/1999 | Tebbe ..... 424/402 |
| 6,115,873 | A | | 9/2000 | Dunkley |
| 6,425,136 | B1 | * | 7/2002 | Schlamp et al. ..... 2/159 |
| 6,539,549 | B1 | | 4/2003 | Peters, Jr. |
| 6,825,393 | B2 | | 11/2004 | Roe et al. |
| 7,108,440 | B1 | | 9/2006 | Gruenbacher |
| 7,467,420 | B2 | | 12/2008 | Ponce et al. |
| 7,478,957 | B1 | | 1/2009 | Thornton |

* cited by examiner

*Primary Examiner* — Rachel Steitz
(74) *Attorney, Agent, or Firm* — Wayne L. Lovercheck

(57) ABSTRACT

A disposable body lotion applicator and method of application in which removable gloves with an impermeable surface on the inside and an absorbent material on the front side are adhered to a substrate which is temporarily adhered to a wall or other suitable surface at a preferred height and position with two-sided sticky tape or other suitable weak adhesive and on which body lotion is applied first to allow a person to spread lotion on his own entire back without holding the applicator by rubbing the back against the applicator and then in which the gloves are removed from the substrate to finish applying lotion to the body without getting lotion on the hands.

16 Claims, 5 Drawing Sheets

DISPOSABLE BODY LOTION APPLICATOR

CROSS REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

The present invention pertains to a disposable body lotion applicator and, more particularly, pertains to a disposable body lotion applicator and method of application in which gloves with an impermeable surface on the inside and an absorbent material on the front side are removably adhered to a substrate which is temporarily adhered to a wall or other suitable surface at a preferred height and position with two-sided sticky tape or other suitable weak adhesive and which is covered with body lotion on the front side which allows a person to spread lotion on his or her own entire back, without holding the applicator and by rubbing the back against the applicator, and then in which the gloves are removed from the substrate and used to finish applying lotion to the entire body, the body lotion applicators being packaged in singles or multiples which fold in half for packaging or in a continuous roll for use in a dispenser and available also in dry form so that a person can select and apply his own lotion.

BACKGROUND OF THE INVENTION

In the use of body lotion for the entire body, there is often the desire to be able to apply the lotion to one's own entire back and also to apply the lotion to the body without getting lotion on the hands. To accomplish the application of the body lotion in this manner, there is also the desire to have a disposable applicator for this purpose, the disposable applicators also being available either in single packages, multiple packages or in dispenser form.

The prior art Strong U.S. Pat. No. 5,636,406 shows adhesive covering a first side of an impervious substrate to stick to a hand and body lotion covering a second side affixed with a lotion applicator pad for applying body lotion to a body. The prior art also shows gloves with an impermeable surface to keep hands free of lotion and an absorptive surface to hold body lotion to be applied. Much of the prior art reveals devices to be covered with body lotion and attached to a stick to be hand-held while applying body lotion to one's own back.

Despite the various body lotion applicators revealed in the prior art, many features of the present invention, and several steps in the method of the present invention, remain new and unique to the prior art, as follows:

None of the prior art anticipates gloves adhered to a substrate to apply body lotion to one's own back, the substrate being removably adhered to a wall or other suitable surface at a preferred height and position, where a person rubs his back against the body lotion spread on the gloves and substrate or an applicator. No prior art anticipates a substrate temporarily adhered to a wall or other suitable surface by means of two-sided sticky tape or other suitable adhesive to support gloves and the substrate for applying body lotion to a person's back or for removing the gloves and using them to apply the lotion on the rest of the body. No prior art anticipates gloves attachable to a substrate, or gloves removable from a substrate, to apply body lotion to a body.

BRIEF SUMMARY OF THE INVENTION

The present invention offers a disposable body lotion applicator, comprised of a pair of gloves removably adhered to a substrate and covered with pre-applied body lotion, and method for applying body lotion to a user's own back by temporarily adhering the applicator to a wall or other suitable surface at a preferred height and position, then rubbing one's back against the pre-lotioned gloves and substrate to spread the lotion over the entire back, and then turning and sliding hands into the gloves and detaching the gloves from the substrate to continue applying lotion to the entire body, keeping the hands free of lotion.

The applicator is disposable for a one-time application, coming in single applicator packaging, multiple applicator packaging or in a continuous roll to be used in a dispenser. The applicator consists of a pair of gloves laid flat and removably adhered to a substrate with two-sided sticky tape or other suitable adhesive between the gloves and substrate, the gloves appearing as though cut out of the substrate. The substrate is in the shape of a rectangle large enough to nearly cover the surface of an adult back. The remaining surface of the substrate not attached to the gloves is covered by and consists of the same material as the top surface of the gloves, thereby forming one flat surface which is covered with pre-applied body lotion, or which is available dry for a person to apply his or her own body lotion. The remaining surface of the substrate which is not adhered to the glove is not removable from the backing of the substrate. The backing of the substrate is affixed with two-sided sticky tape or other suitable adhesive, covered with a non-adhesive strip before use.

The front surface of the gloves and the substrate are made of an absorbent material which can hold body lotion. The inner surface of the gloves is made of an impermeable surface to keep the hands free of lotion. The gloves are in the shape of mitts, consisting of a thumb area and one large area for all the fingers. In an alternative embodiment, the gloves may be provided with five finger spaces. The position of the gloves on the substrate is one on each half of the substrate with the openings for the hands facing each side where the hands will be inserted, one toward the left and one toward the right. The applicator may come with lotion pre-applied or without lotion. The applicator is covered with a removable front sheet to protect the front surface of the applicator and any pre-applied lotion.

To apply the body lotion to one's own back, a user removes the disposable applicator from the packaging, then removes the non-adhesive strip from the sticky tape or other adhesive on the backing of the substrate and temporarily sticks the substrate to a wall or other suitable surface at a preferred height and position in line with the user's back. The user then removes the front sheet of the applicator, exposing the pre-applied lotion, turns his back facing the applicator and rubs his back against the lotion, spreading the lotion over the entire back. If the applicator comes in the form without the pre-applied lotion, the user would apply lotion to the applicator before adhering the applicator to the wall or other suitable surface.

To continue spreading lotion over the entire body, the user then slides his hands into the gloves, palm facing the front of the gloves, detaches the gloves from the substrate and spreads lotion on the entire body. The applicator is then removed from the wall or surface and disposed.

It is an object of the present invention to provide a body lotion applicator for applying body lotion to one's own back without having to hold the applicator during application.

It is another object of the present invention to provide a body lotion applicator that is simple in construction, economical to manufacture and simple and efficient to use.

It is another object to provide gloves adhered to a substrate to apply body lotion to a body by rubbing one's back against the gloves and substrate, the substrate being removably adhered to a wall or other suitable surface at a preferred height and position.

It is another object to provide a body lotion applicator in the form of gloves adhered to a substrate which is temporarily adhered to a wall or other suitable surface by two-sided sticky tape or other adhesive.

It is another object of the invention to provide gloves removable from a substrate to apply body lotion to a body.

It is another object of the invention to provide an applicator covered with body lotion and ready for use.

It is another object of the invention to provide an alternative type of applicator in dry form to which a person applies his own body lotion.

It is another object of the invention to provide a body lotion applicator in the form of gloves adhered to a substrate by two-sided sticky tape or other suitable adhesive, the substrate being temporarily adhered to a wall or other suitable surface at a preferred height and position where the user spreads lotion on his entire back by rubbing the back on the surface of the applicator, then turns and inserts his hands in the gloves, detaches the gloves from the substrate, then continues spreading body lotion over the entire body.

It is another object of the invention to provide a body lotion applicator containing pre-applied lotion on the front surface of the gloves and substrate, the front surface being protected by a front sheet.

It is another object of the invention to provide a body lotion applicator on which the user can apply lotion after the applicator is removed from the packaging.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE SEVERAL VIEWS OF THE DRAWINGS

FIG. 2 is a perspective view of the body lotion applicator of the present invention illustrating the applicator folded in half with the front side folded in.

DETAILED DESCRIPTION OF THE INVENTION

Now with more particular reference to the drawings, shown is FIGS. 1-10, illustrating a disposable body lotion applicator 10, comprising gloves 20 adhered to a substrate 30, both of which are covered with pre-applied lotion 28, and method of application which allows self-application of body lotion to a user's back by rubbing the back against the applicator and then application of body lotion to an entire body by removing the gloves 20 from the substrate 30 and spreading the body lotion on the body without getting lotion on the hands.

Figure 1:
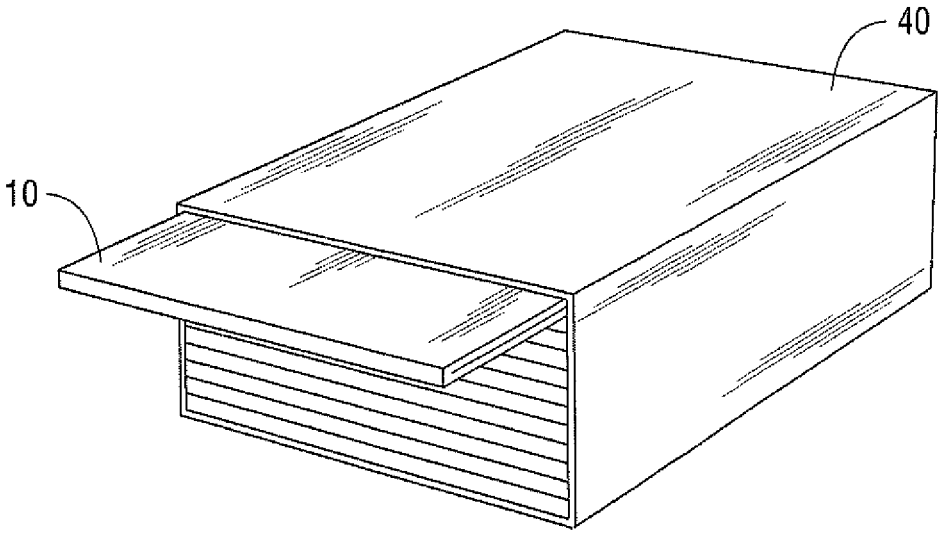
FIG. 1 is a perspective view of the packaging and body lotion applicator of the present invention illustrating multiple applicators folded in half and in the packaging.

FIG. 1 shows a package 40 for holding a small number of single disposable applicators 10 folded in half.

Figure 2:
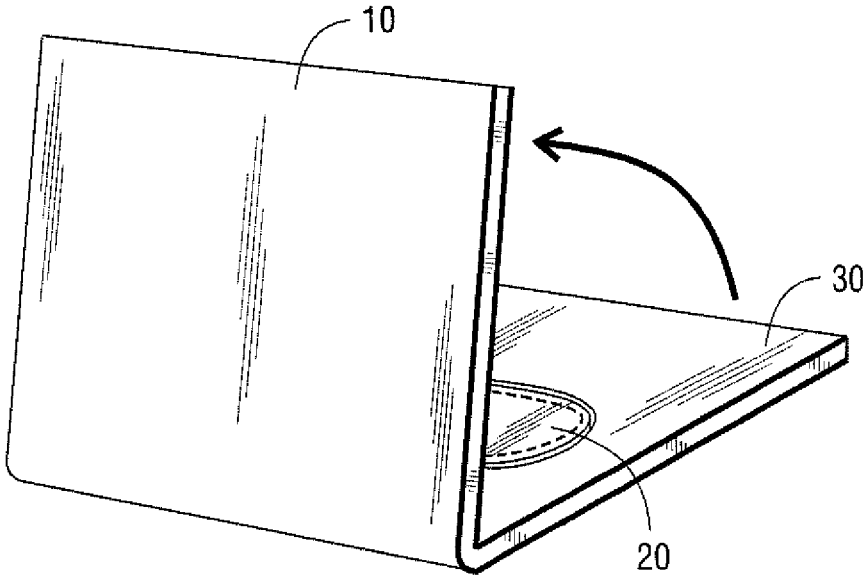

FIG. 2 shows a single applicator 10 folded in half and opening on one side with the gloves 20 and front surface of the substrate 30 on the inside of the folded applicator 10. Also shown in FIG. 2 is a view of part of one of the gloves 20 on the front surface of the applicator.

Figure 3:
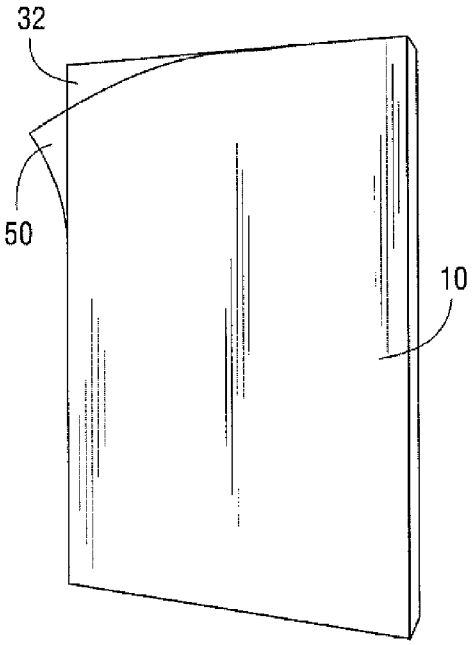
FIG. 3 is a rear elevational view of the body lotion applicator illustrating the non-adhesive removable sheet, covering the two-sided sticky tape or other adhesive, covering the back surface of the substrate for adhering the applicator to a wall or other suitable surface.

FIG. 3 shows the rear view of the open applicator 10 and the non-adhesive sheet 50 being removed from the back of the applicator to expose the two-sided sticky tape or adhesive 32 by which the applicator will be adhered to a wall or other suitable surface.

Figure 4:
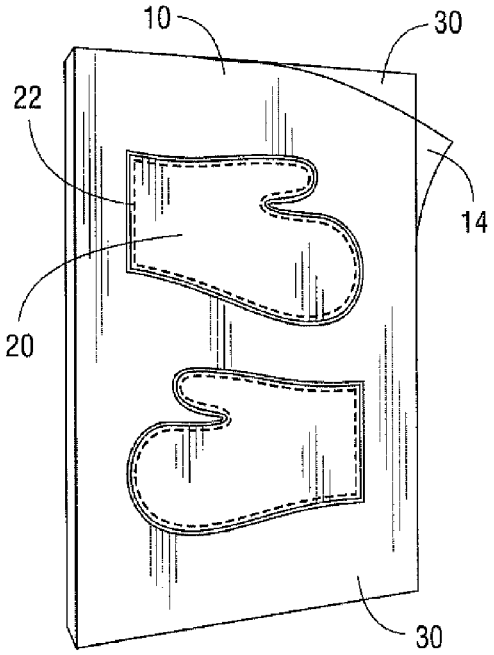
FIG. 4 is a front elevational view of the body lotion applicator illustrating the pair of gloves on the front surface of the substrate and illustrating a protective, removable front sheet.

FIG. 4 shows the applicator 10 open for use with the gloves 20 arranged so that each opening for insertion of the hand is facing the hand to be inserted. The gloves 20 are shown as being entirely open on the inside with an insertion point 22 for the hands. Also shown is the removable front sheet 14 used for protecting the front surface of the substrate 30.

Figure 5:
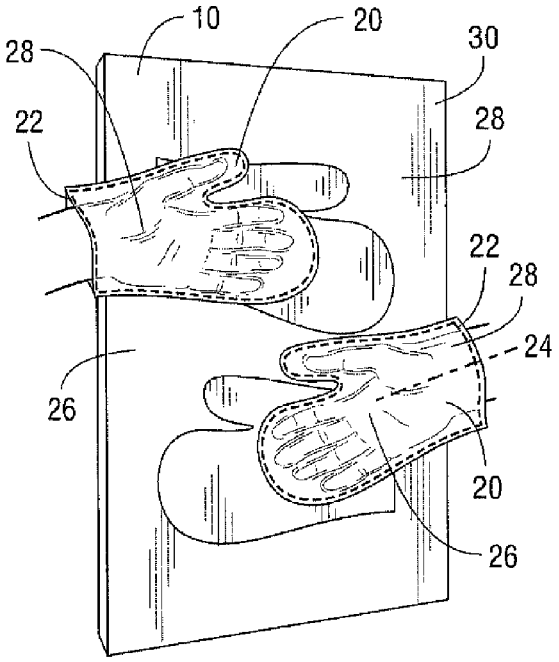
FIG. 5 is a view similar to FIG. 4 but illustrating the applicator once the front protective sheet has been removed and illustrating hands inserted in the gloves, palms facing front, the gloves partially removed from the substrate, the substrate remaining stationary, and the absorbent material of the gloves and substrate covered with pre-applied lotion.

FIG. 5 shows the applicator 10, after the protective sheet (not shown) has been removed, and hands inside the gloves 20, palms facing front, inserted through the openings 22 and the gloves 20 partially removed from the applicator 10, the substrate 30 remaining adhered to a wall or other suitable surface (not shown) and stationary. Also indicated is the impermeable surface of the inside of the gloves 24, the absorbent surface on the front of the gloves and substrate 26 and the pre-applied lotion 28 on the gloves 20 and substrate 30.

Figure 6:
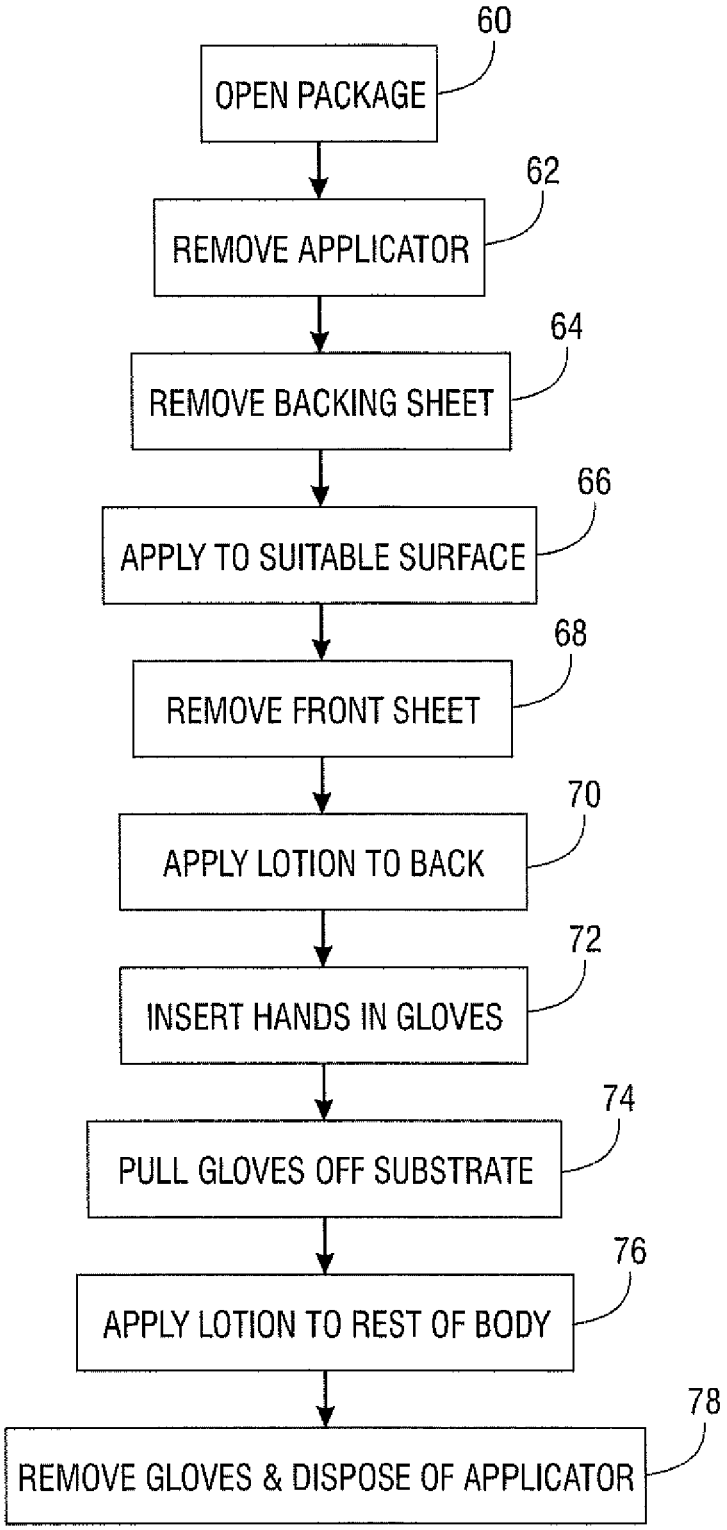
FIG. 6 is a flow chart of the method of using the body lotion applicator of the present invention.

FIG. 6 shows a flow chart of the method for using the body lotion applicator, the steps in the method being: open package 60, remove applicator 62, remove backing sheet 64, apply to wall or other suitable surface 66, remove front sheet 68, apply lotion to back 70, accomplished by rubbing the back on the applicator (not shown), insert hands in gloves 72, pull gloves off substrate 74, apply lotion to rest of body 76, using the gloves (not shown), remove and dispose of applicator 78.

Figure 7:
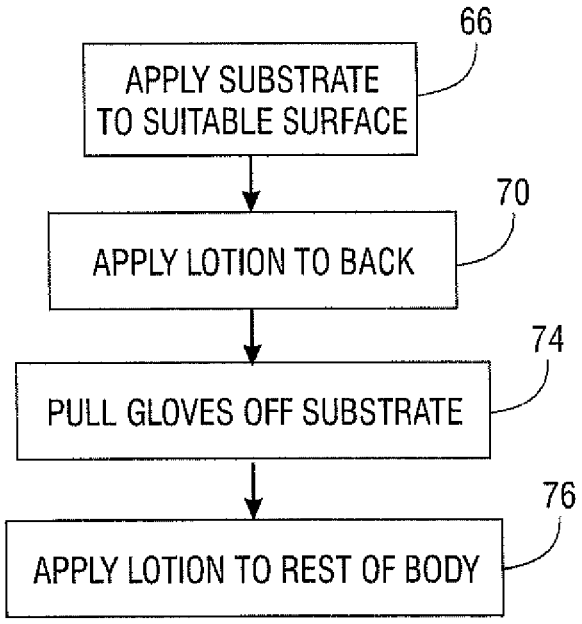
FIGS. 7 and 8 are more concise flow charts of the method of using the body lotion applicator of the present invention.

FIG. 7 shows a more concise flow chart of the method for using the body lotion applicator, the steps in the method being: apply substrate to suitable surface 66, apply lotion to back 70, pull gloves off substrate 74, apply lotion to rest of body 76.

Figure 8:
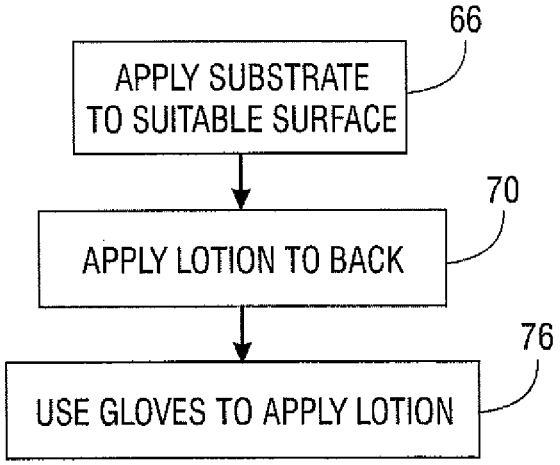

FIG. 8 shows a more concise flow chart of the method for using the body lotion applicator, the steps in the method being: apply substrate to suitable surface 66, apply lotion to back 70, apply lotion to rest of body using gloves 76.

Figure 9:
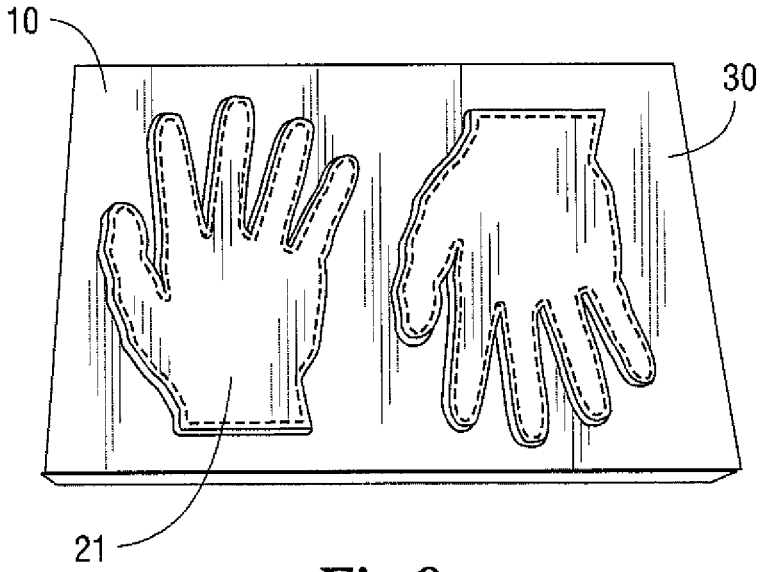
FIG. 9 is a view of the packaged applicator with the five-finger-shaped gloves.

FIG. 9 shows the packaged applicator 10 on the substrate 30 with the five-finger-shaped gloves 21.

Figure 10:
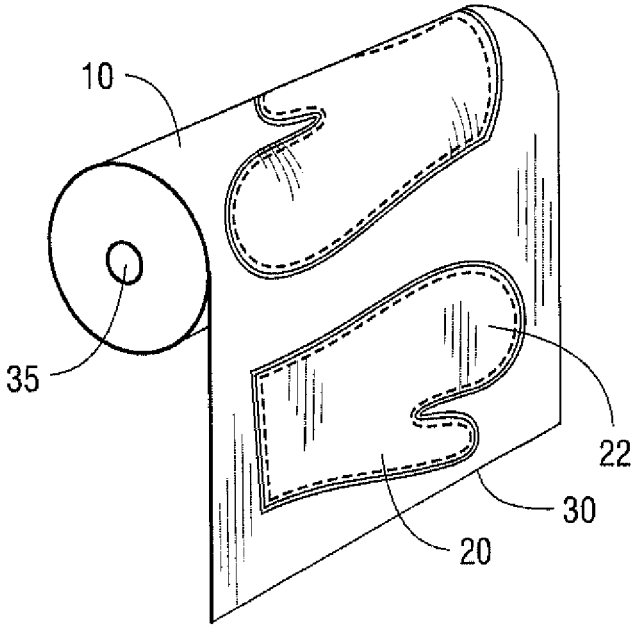
FIG. 10 is a view of the packaged applicator in a continuous roll dispenser.

FIG. 10 shows the packaged applicator 10 in a continuous roll dispenser 35.

The foregoing specification sets forth the invention in its preferred, practical forms but the structure shown is capable of modification within a range of equivalents without departing from the invention which is to be understood is broadly novel as is commensurate with the appended claims.

I claim:

1. A disposable applicator which allows self-application of body lotion to a person's entire back without holding the applicator and to the rest of the body without getting lotion on the hands, comprising:

a pair of gloves with an impermeable material on the inside of the gloves and an absorbent material on the front side of the gloves for holding body lotion, removably adhered on the back side of the gloves with a suitable adhesive to a substrate large enough to cover the surface of an adult back;

the substrate covered with the absorbent material on the front side of the substrate, permanently covering the remaining area of the substrate not covered by the gloves, and a suitable adhesive on the entire back side of the substrate for adhering the substrate to a wall or other suitable surface at a preferred height and position;

the substrate to support removable gloves to apply body lotion to a body;

the front surface of the gloves and substrate covered with pre-applied lotion;

a removable, protective front sheet covering the pre-lotioned front surface of gloves and substrate;

a removable non-adhesive material covering the back side of the substrate to protect the adhesive surface until the substrate is to be adhered to a wall or other suitable surface.

2. The body lotion applicator of claim 1 in a package for holding single applicators.

3. The apparatus of claim 1 in a package containing multiple applicators.

4. The apparatus of claim 1 wherein multiple applicators are provided in a continuous roll in a dispenser or packaged flat to be sold in a box.

5. The apparatus of claim 1 wherein the gloves are in a five-finger shape.

6. The body lotion applicator of claim 1 wherein the gloves are in the shape of mitts.

7. The body lotion applicator of claim 1 wherein the back side of the substrate is adhered with two-sided sticky tape.

8. A disposable body lotion applicator which allows self-application of body lotion to a person's entire back without holding the applicator and to the rest of the body without getting lotion on the hands, comprising:

a pair of gloves with an impermeable material on the inside of the gloves and an absorbent material on the front side of the gloves for holding body lotion, removably adhered on the back side of the gloves with a suitable adhesive to a substrate large enough to cover the surface of an adult back;

the substrate covered with the absorbent material on the front side of the substrate, permanently covering the remaining area of the substrate not covered by the gloves, and a suitable adhesive on the entire back side of the substrate for adhering the substrate to a wall or other suitable surface at a preferred height and position;

the substrate to support removable gloves to apply body lotion to a body;

a removable non-adhesive material covering the back side of the substrate to protect the adhesive surface until the substrate is to be adhered to a wall or other suitable surface;

the substrate and gloves being in dry form, without pre-applied lotion, to which the user applies body lotion before using.

9. The disposable body lotion applicator of claim 8 wherein multiple applicators are packaged in a continuous roll to be dispensed from a dispenser or packaged flat to be sold in a box.

10. The applicator recited in claim 1 provided in reusable form.

11. The body lotion applicator recited in claim 8, wherein the gloves are in a five-finger shape or are in the shape of mitts.

12. The body lotion applicator of claim 8, wherein the back side of the substrate is adhered with two-sided sticky tape.

13. An apparatus for self-applying body lotion to a person's back and any other parts of the body comprising:

a package containing an applicator, said applicator comprising a pair of gloves on a substrate, the substrate having a backing sheet on its back side, the backing sheet covering an adhesive or sticky tape on the back of the substrate, suitable for temporarily supporting the apparatus on a wall or other suitable vertical surface, a front sheet may be removed from a front surface of the substrate which is provided with a permeable lotion-filled material for covering the person's back with lotion, the user may then insert his or her hands into the provided gloves and pull them off of the substrate for applying lotion to the rest of the body, when the application is complete, the user removes the gloves and may dispose of the applicator.

14. The apparatus of claim 13 packaged with multiple applicators.

15. The apparatus of claim 13 packaged with multiple applicators in a continuous roll for a dispenser or packaged flat to be sold in a box.

16. The apparatus of claim 13 wherein the gloves are in a five-finger shape.

* * * * *